US006831536B1

(12) United States Patent
Zindler

(10) Patent No.: US 6,831,536 B1
(45) Date of Patent: Dec. 14, 2004

(54) CIRCUIT BREAKER SLOT MOTOR HAVING A STEPPED OUT PORTION

(75) Inventor: Mark O. Zindler, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/651,472

(22) Filed: Aug. 29, 2003

(51) Int. Cl.[7] ..... H01H 9/30
(52) U.S. Cl. ..... 335/201; 335/6
(58) Field of Search ..... 335/6–16, 147, 335/18, 5, 195, 201

(56) References Cited

U.S. PATENT DOCUMENTS 3,815,059 A 6/1974 Spoelman
4,970,482 A 11/1990 Jacobs et al.
6,060,674 A 5/2000 Malingowski et al.
6,225,882 B1 5/2001 Hood et al.
6,281,459 B1 * 8/2001 Munsch et al. ..... 218/22

* cited by examiner

*Primary Examiner*—Ramon M. Barrera
(74) *Attorney, Agent, or Firm*—Martin J. Moran

(57) ABSTRACT

An upper slot motor assembly for a circuit breaker slot motor assembly where the upper slot motor assembly includes a housing assembly and a plurality of plates, and the plates generally correspond to the shape of the housing assembly. The house assembly has a U-shape with a bight, a first and second leg, and a gap between said legs. The gap has a narrow portion and a wide portion. When installed about the circuit breaker separable contacts, the gap narrow portion is located near the stationary contact and the gap wide portion is located near the movable contact when the movable contact is in the open position.

20 Claims, 4 Drawing Sheets

CIRCUIT BREAKER SLOT MOTOR HAVING A STEPPED OUT PORTION

BACKGROUND OF THE INVENTION

1. Field of the Invention

The present invention relates to circuit breakers and, more specifically, to a slot motor for a circuit breaker wherein the slot motor has two legs separated by a gap and the gap has a narrow portion and a stepped out portion.

2. Background Information

Circuit breakers, including molded case circuit breakers, have at least one pair of separable contacts. A first contact is fixed within the molded case housing and the other contact, the "movable contact," is coupled to an operating mechanism. Both contacts are disposed on "arms" that are in electrical communication with either the line or load coupled to the circuit breaker. The operating mechanism is structured to move the movable contact between a first, open position wherein the movable contact is spaced from the fixed contact, and a second, closed position wherein the fixed and movable contacts are in contact and electrical communication. The operating mechanism may be operated manually or by the circuit breaker's trip mechanism. To enhance the speed of separation of the contacts, the contacts may be disposed within a slot motor.

A slot motor is a ring or loop-shaped device made of magnetically permeable material which surrounds the contacts and contact arms of a circuit breaker. When the circuit is live, an electrical arc may be drawn between the electrical contacts during separation. The electrical current interacts electromagnetically with the slot motor to induce a magnetic field in the magnetic material of the slot motor which in turns interacts with the separating contact arms to accelerate the contact opening process. An example is found in U.S. Pat. No. 4,970,482 issued Nov. 13, 1990 to Jacobs et al, entitled "Current Limiting Circuit Breaker Arc Chute Configuration".

Slot motors generally have two assemblies, an upper assembly and a lower assembly. Both upper and lower assemblies include a housing and a plurality of plates composed of the magnetically permeable material. The lower assembly is disposed below the fixed contact. As shown in FIG. 1, the upper assembly is an inverted U-shaped assembly having a housing assembly 1 and a plurality of plates 2, forming a bight portion 3, two legs 4, 5. The upper slot motor is structured to be disposed over the movable contact wherein the tips of the upper assembly leg contact the lower assembly. The legs of the U-shaped upper assembly have an extended length to accommodate the path of travel of the movable contact arm. That is, the movable contact is disposed between the legs of the upper assembly and as the movable contact moves between the first, open position and the second, closed position, the movable contact moves from a position adjacent to the upper assembly bight to a position adjacent the tips of the legs. Accordingly, the legs must have a sufficient length to accommodate the path of travel of the movable contact arm. It should further be noted that the movable contact arm may, due to manufacturing tolerances, be free to shift a short distance laterally while moving.

The prior art slot motors have a generally uniform gap between the legs of the U-shaped upper assembly. In other words, the inner surfaces 6, 7 of the legs 4, 5 adjacent to the movable contact, are generally parallel. Moreover, the inner surface 6, 7 of each leg is typically within 0.6 inch of the movable contact. Such prior art slot motors are subject to failure due to carbon build up which creates a voltage path when the contacts are in the first, open position. That is, when the contacts are opened and an arc created, carbon is deposited on the upper assembly inner surface. Over time, the carbon builds up and eventually allows voltage to travel from the movable contact through the carbon to the fixed contact. The chance of a voltage path being created is enhanced when the movable contact arm shifts laterally toward either leg inner surface 6, 7. This situation is unacceptable as current may flow through the circuit breaker even after the circuit breaker has tripped or has been manually opened.

There is, therefore, a need for a slot motor structured to prevent a voltage path from forming on the surface of the slot motor.

There is a further need for the improved slot motor to be compatible with existing circuit breaker housings.

SUMMARY OF THE INVENTION

These needs, and others, are met by the present invention which provides a slot motor having an inner surface with a stepped out portion. The outer surface of the slot motor maintains the same, U-shaped profile of the prior art slot motor. As such, the slot motor of the present invention may be used in prior art circuit breakers. The inner surface on each leg or the slot motor has an inset portion and a stepped out portion, or, stated alternately, the gap between the legs of the upper slot motor has a narrow portion and a wide portion. The inset, or narrow gap, portion is disposed adjacent to the distal end of each leg and the stepped out, or wide gap, portion is disposed adjacent to the bight of the U-shaped slot motor. The gap between the inset portions, the narrow gap, is generally about 0.256 inch and the gap at the stepped out portion, the wide gap, is generally about 0.356 inch.

In operation, when the circuit breaker contacts are closed, the contacts are disposed between the inset portions of the slot motor which corresponds to the narrow portion of the gap. Thus, when the contacts begin to separate, the slot motor is generally within 0.033 inch of the contacts. The proximity of the contacts to the slot motor upper slot motor assembly inner surface at the inset portion enhances the strength of the magnetic field created by the arc during the initial separation arid therefore enhances the speed of separation. As the movable contact moves into the stepped out portion of the slot motor, the gap between the legs widens. At the end of the separation, the movable contact is disposed in the stepped out portion. Thus, the movable contact is disposed about 0.053 inch from the inner surface while in the first, open position. This gap is sufficient to prevent a voltage path from forming along the inner surface of the slot motor, even when the inner surface is coated with carbon.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, e.g. "above," "below," "upper," "lower," etc., are used for convenience relative to the Figures and are not intended to limit the claims.

Figure 2:
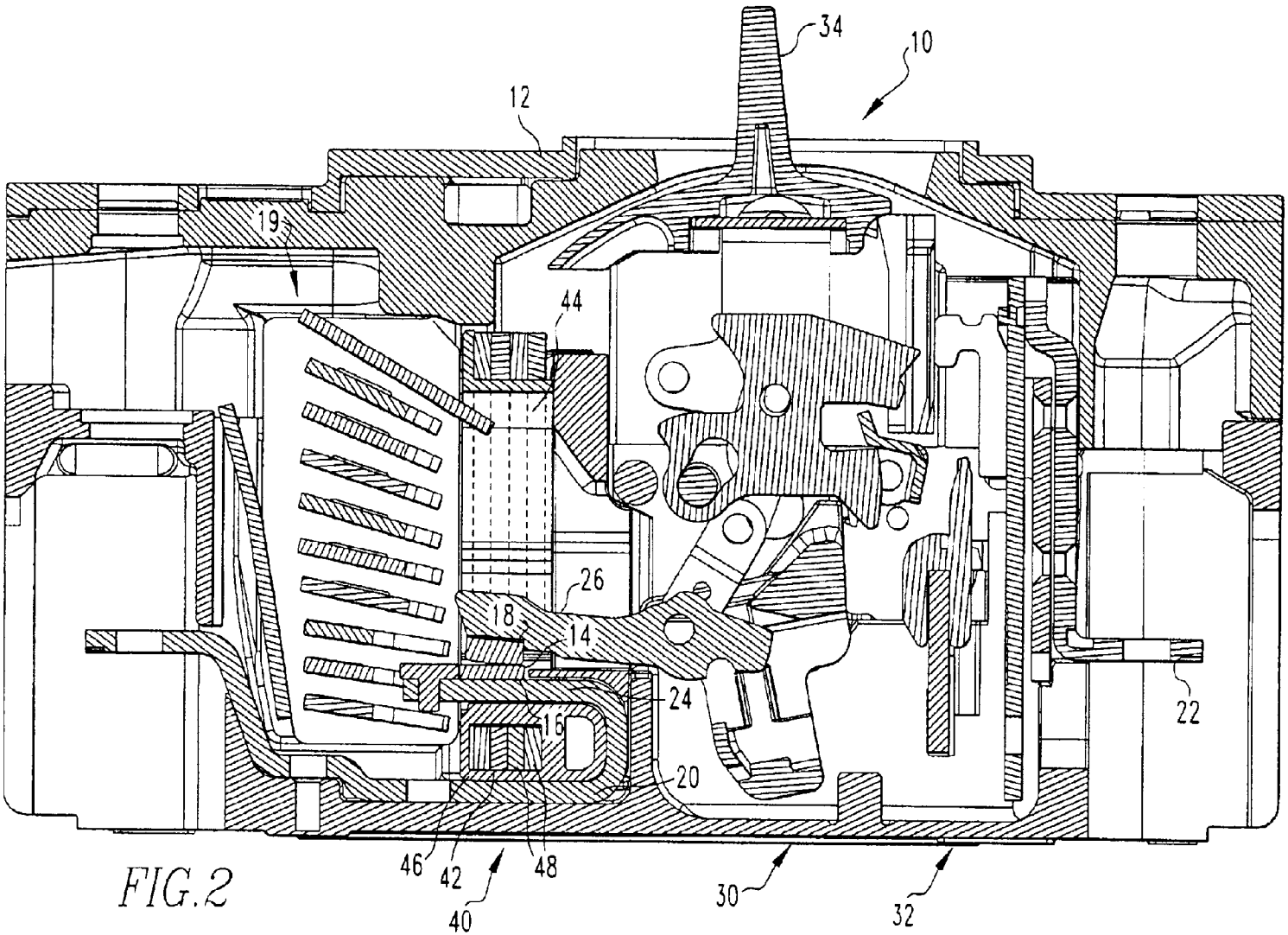
FIG. 2 is a side view of a 3-pole circuit breaker.

As shown in FIG. 2, a circuit breaker 10 includes a housing 12 and at least one set of contacts 14. Typically, there is one set of contacts 14 for each pole of the circuit breaker 10. Because the slot motor assembly 40 of the present invention is associated with an individual set of contacts 14, the slot motor assembly 40 may be used with single pole or multi-pole circuit breakers 10. The main contacts 14 include a stationary contact 16 and at least one movable contact 18. The stationary contact 16 is in electrical communication with a line conductor 20. The line conductor 20 extends through the housing 12. The movable contact 18 is in electrical communication with an elongated load conductor assembly 22. The load conductor assembly 22 extends through the housing 12. The line conductor 20 includes a stationary contact arm 24, upon which the stationary contact 16 is disposed. The load conductor assembly 22 includes a movable contact arm 26. The circuit breaker 10 further includes an operating mechanism 30, a trip mechanism 32, and an operating handle 34. The housing 12 may also include an arc chute 19 structured to absorb and dissipate the arc created by separation of the contacts 14.

The movable contact 18, and more specifically, the movable contact arm 26 is coupled to the operating mechanism 30. The operating mechanism 30 is structured to move the movable contact 18 between a first, open position (FIG. 3) wherein the contacts 14 are separated, and a second, closed position (FIG. 2) wherein the contacts 14 are in electrical communication. The operating mechanism 30 is operably coupled to the trip mechanism 32 and the handle 34. Thus, the operating mechanism 30 maybe actuated manually, by the handle 34, or in response to an over-current condition, by the trip mechanism 32.

Figure 3:
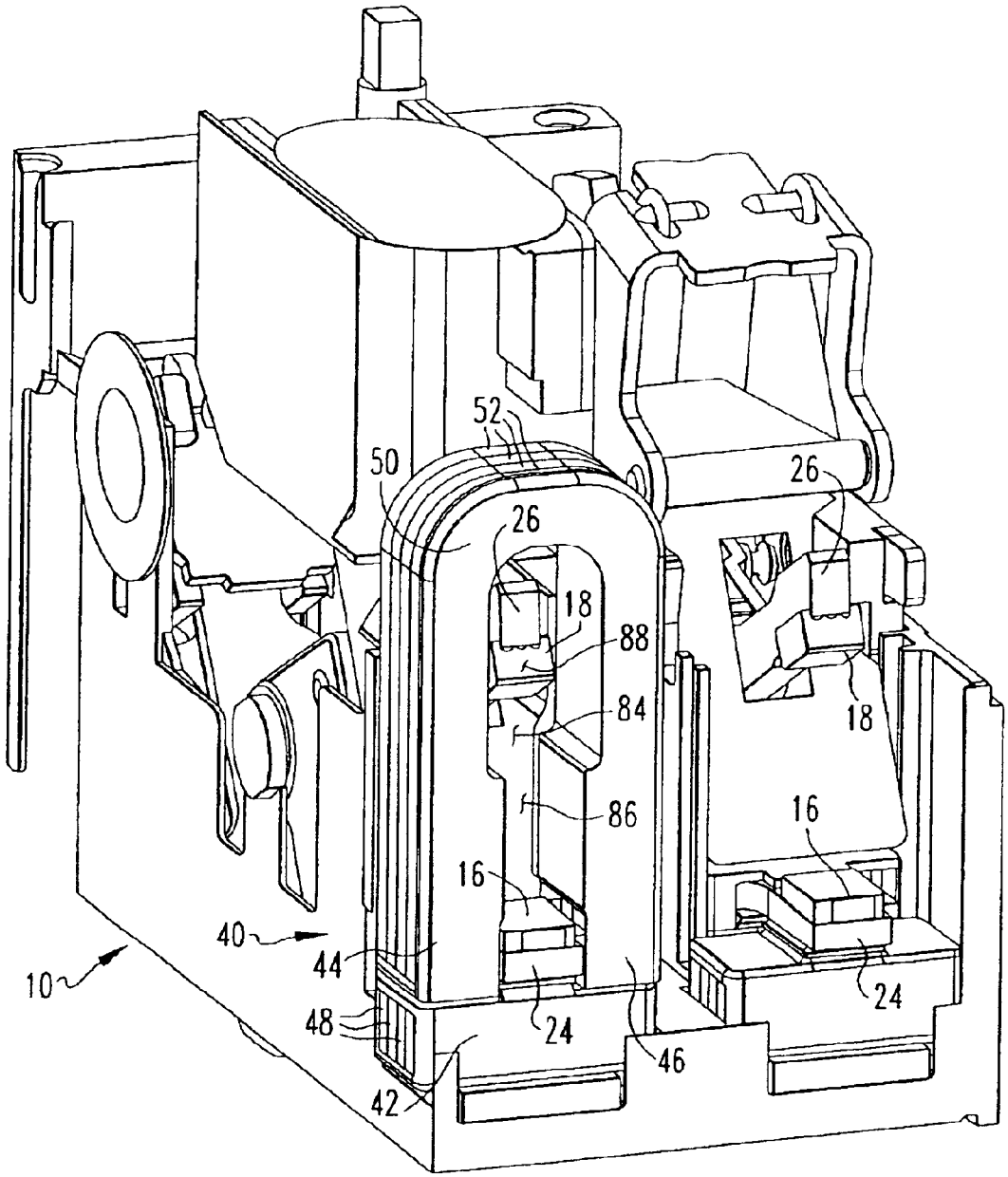
FIG. 3 is an isometric view of the upper slot motor of the present invention.

As shown in FIGS. 2 and 3, the slot motor assembly 40 includes a lower slot motor assembly 42 and an upper slot motor assembly 44. The lower slot motor assembly 42 includes a housing 46 and a plurality of plates 48. The plates 48 are made from a magnetically permeable material such as, but not limited to, carbon steel, and are structured to create a magnetic field. The lower slot motor assembly 42 is shaped, generally, as a straight, elongated block. As shown on FIG. 3, the lower slot motor assembly 42 is disposed below the stationary contact 16 and extends laterally on both sides of the stationary contact 16.

Figure 1:
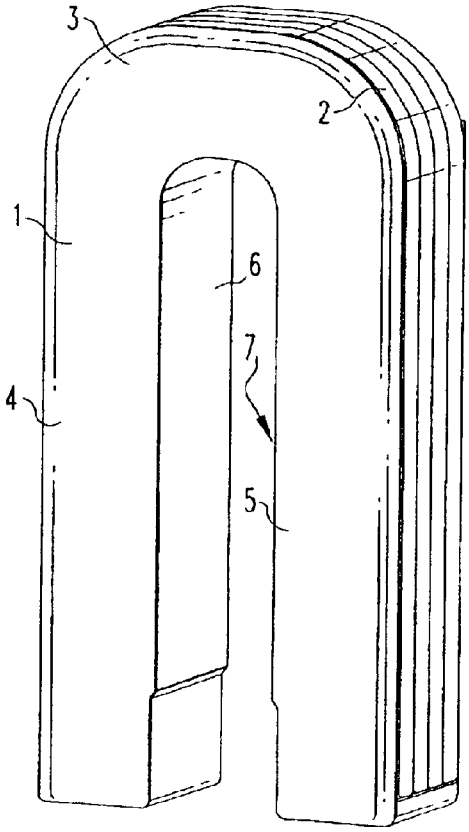
FIG.1 PRIOR ART
FIG. 1 is an isometric view of the prior art upper slot motor.
Figure 4:
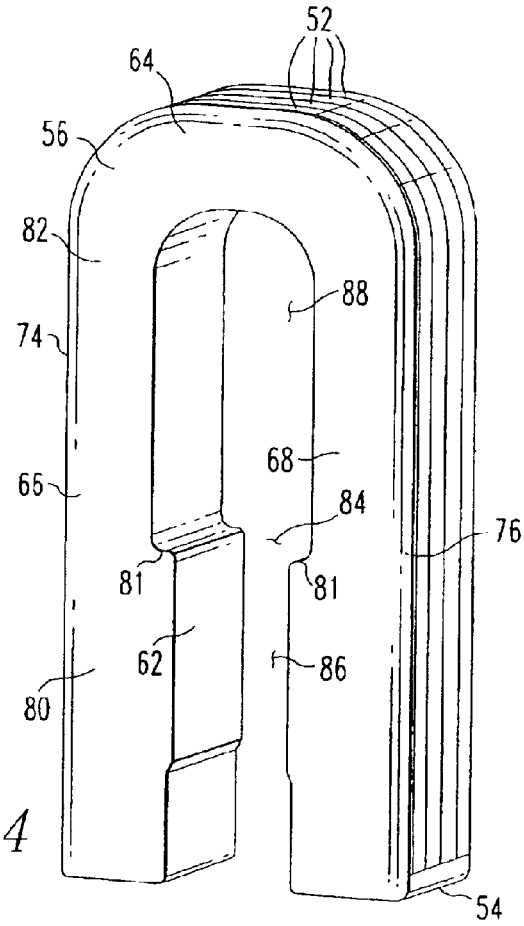
FIG. 4 is an isometric view of the slot motor of the present invention disposed in a two-pole circuit breaker.

As shown in FIGS. 3 and 4, the upper slot motor assembly 44 includes a housing 50 and a plurality of plates 52. The upper slot motor assembly plates 52, like lower slot assembly plates 48, are made from a magnetically permeable material such as, but not limited to, carbon steel, and are structured to create a magnetic field. The housing 50 is made from a dielectric material such as, but not limited to, thermoset plastic. Also the material of the housing 50 may comprise a gas evolving material such as cellulose filled Melamine Formaldehyde which helps to move the contact separation arc, described below, toward the arc chute 19 and it flattens it against the arc plates in the form of a band or ribbon. The upper slot motor assembly plates 52 correspond to the shape of the upper slot motor assembly housing front plates 56, as shown best in FIG. 6, and are generally disposed adjacent to the upper slot motor assembly housing front plate 56, described below. In this respect, the upper slot motor assembly plates 52 generally correspond to the shape of said upper slot motor assembly housing 50.

Figure 5:
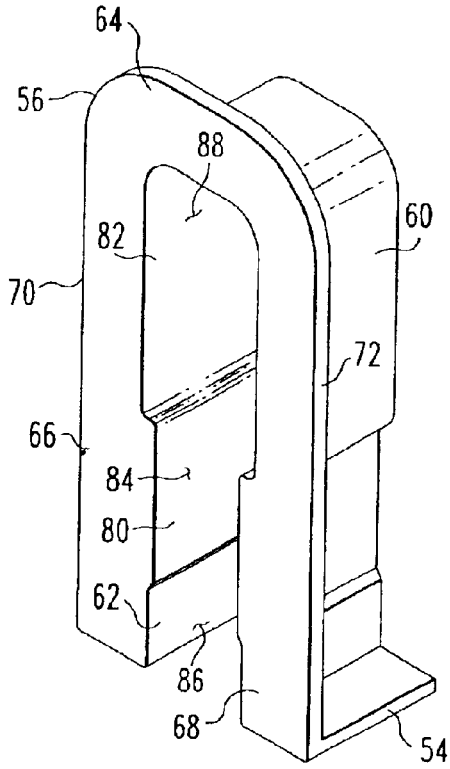
FIG. 5 is an isometric view of the upper slot motor housing of the present invention.
Figure 6:
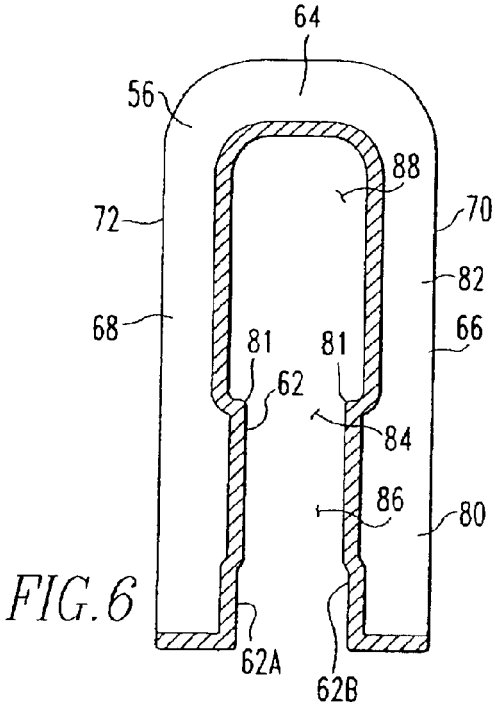
FIG. 6 is a front view of the upper slot motor housing of the present invention.
Figure 7:
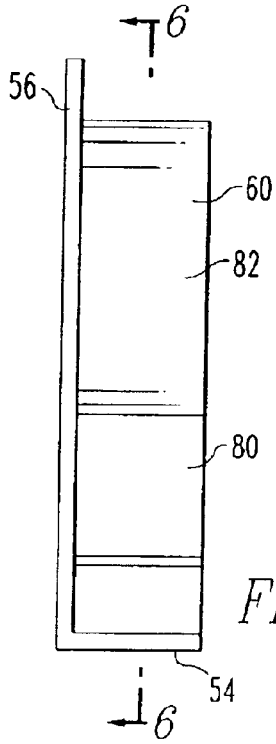
FIG. 7 is a side view of the upper slot motor housing of the present invention.

The upper slot motor assembly housing 50, shown in FIGS. 5-7, comprises a pair of end plates 54, a front plate 56, and an inner-support 58. The inner-support has a plate engaging surface 60 and an inner surface 62. The inner-support 58 is basically an inverted "U" having a bight portion 64, and opposing first and second legs 66, 68. The axis of the first and second legs 66, 68 are generally parallel. As shown in FIGS. 3 and 4, the upper slot motor assembly plates 52 are disposed on the U shaped inner-support 58 and contact the plate engaging surface 60. The upper slot motor assembly housing front plate 56 has a pair of generally parallel vertical edges 70, 72 extending from the bight portion 64 to the distal ends of the legs 66, 68. The end plates 54 extend rearwardly from the front plate 56 at the distal ends of the legs 66, 68. The upper slot motor assembly housing 50 has an inset portion 80, disposed adjacent to the distal ends of the first and second legs 66, 68, and a stepped out portion 82, disposed adjacent to the bight portion 64. Between the inset portion 80 and the stepped out portion 82 is a transition 81. That is, the upper slot motor assembly housing front plate 56 is wider near the distal ends of the first and second legs 66, 68 and the inner-support 58 is also inset near the distal ends of the first and second legs 66, 68.

Between the first leg inner surface 62A and the second leg inner surface 62B is a gap 84. The gap 84 has a narrow portion 86 that corresponds to the upper slot motor assembly housing inset portion 80, and a wide portion 88 that corresponds to the stepped out portion 82. The gap narrow portion 86 has a width of between about 0.251 and 0.261 inch, and more preferably about 0.256 inch. The gap wide portion 88 has a width of between about 0.351 and 0.356 inch, and more preferably about 0.351 inch.

When the upper slot motor assembly 44 is installed, as shown in FIG. 4, the upper slot motor assembly 44 is disposed within the circuit breaker housing 12 with the distal ends of first and second legs 66, 68 contacting the lower slot motor assembly 42 and disposed on either side of the movable contact 18. In this configuration, the slot motor assembly 40 is formed having an essentially contiguous loop of magnetically permeable material, i.e. the lower and upper slot motor assembly plates 48, 52, extending about the contacts 14 and about the path of travel of the movable contact 18. Thus, during separation of the contacts 14, electrical current continues to flow in the movable contact arm 26 and through an electric arc between the stationary contact 16 and the movable contact 18. This current induces a magnetic field into the essentially closed magnetic loop provided by the combined upper and lower plates 48 and 52, respectively, in the lower slot motor assembly 42 and upper slot motor assembly 44, respectively. This magnetic field interacts with the aforementioned current electromagnetically in such a way as to accelerate the movement of the movable contact arm 26 in such a manner as to more rapidly separate contacts 14. The higher the electrical current flowing in the arc the higher the magnetic interaction and the more quickly the contacts 14 separate. This operation is also described in U.S. Pat. No. 3,815,059 to Spoelman. The strength of this magnetic field is also a function of the distance between the contacts 14 and the magnetic plates 48 and 52. Thus, at the upper housing assembly inset portion 80 of the upper housing assembly, i.e. the gap narrow portion 86, which is adjacent to the stationary contact 16, the magnetic field is enhanced.

During the separation of the contacts 14 carbon dust is formed. This dust coats the inner-support plate inner surface 62. As noted above, in the prior art, the carbon dust may build up and allow current to jump across the gap between the contacts 14 and the inner-support plate inner surface 62, even when the contacts 14 are in the first, open position. The upper slot motor assembly 44 of the present invention, however, provides the upper slot motor assembly housing 50 having a stepped out portion 82, and a corresponding gap wide portion 88. When the movable contact is in the first, open position, the gap wide portion 88 provides a sufficient distance to prevent a voltage path from forming between the stationary contact 16 and the movable contact 18. That is, the current cannot jump between the movable contact 18 and the inner-support plate inner surface 62 at the stepped out portion 82.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An upper slot motor assembly for a circuit breaker slot motor assembly, said upper slot motor assembly comprising:

a housing assembly and a plurality of plates, said plates generally corresponding to the shape of said housing assembly;

said housing assembly having a U-shape with a bight, a first and second leg, and a gap between said legs;

said gap having a narrow portion and a wide portion; wherein:

said gap wide portion is disposed adjacent to said bight; and said gap narrow portion is disposed adjacent to the distal ends of said first and second legs.

2. The upper slot motor assembly of claim 1, wherein the width of the gap wide portion is between about 0.351 and 0.361 inch.

3. The upper slot motor assembly of claim 2, wherein the width of the gap wide portion is about 0.356 inch.

4. The upper slot motor assembly of claim 1, wherein the width of the gap narrow portion is between about 0.251 and 0.261 inch.

5. The upper slot motor assembly of claim 4, wherein the width of the gap narrow portion is about 0.256 inch.

6. An upper slot motor assembly for a circuit breaker slot motor assembly, said upper slot motor assembly comprising:

a housing assembly and a plurality of plates, said plates generally corresponding to the shape of said housing assembly;

said housing assembly having a U-shape with a bight, a first and second leg, and a gap between said legs;

said gap having a narrow portion and a wide portion;

wherein said upper slot motor assembly housing includes a front plate, and an inner-support, each having a U shape;

said front plate and said inner-support each having an inset portion and a stepped out portion, said inset portion corresponding to said gap narrow portion and said stepped out portion corresponding to said gap wide portion; and wherein each plate of said plurality of plates are shaped to correspond to the shape of said upper slot motor assembly housing front plate.

7. An upper slot motor assembly for a circuit breaker slot motor assembly, said upper slot motor assembly comprising:

a housing assembly and a plurality of plates, said plates generally corresponding to the shape of said housing assembly;

said housing assembly having a U-shape with a bight, a first and second leg, and a gap between said legs;

said gap having a narrow portion and a wide portion;

wherein each said housing assembly includes a U shaped inner-support with a bight, a first and second leg;

said first and second leg each having an inner surface;

each said leg has an inner surface having an inset portion and a stepped out portion, wherein said first leg inset portion is closer to the second leg inset portion than the first leg stepped out portion is to the second leg stepped out portion; and wherein the distance between the first leg inner surface and the second leg inner surface at said stepped out portion is between about 0.351 and 0.361 inch.

8. The upper slot motor assembly of claim 7, wherein the distance between the first leg inner surface and the second leg inner surface at said stepped out portion is about 0.356 inch.

9. An upper slot motor assembly for a circuit breaker slot motor assembly, said upper slot motor assembly comprising:

a housing assembly and a plurality of plates, said plates generally corresponding to the shape of said housing assembly;

said housing assembly having a U-shape with a bight, a first and second leg, and a gap between said legs;

said gap having a narrow portion and a wide portion; wherein each said housing assembly includes a U shaped inner-support with a bight, a first and second leg;

said first and second leg each having an inner surface;

each said leg has an inner surface having an inset portion and a stepped out portion, wherein said first leg inset portion is closer to the second leg inset portion than the first leg stepped out portion is to the second leg stepped out portion; and wherein the distance between the first leg inner surface and the second leg inner surface at said inset portion is between about 0.251 and 0.261 inch.

10. The upper slot motor assembly of claim 9, wherein the distance between the first leg inner surface and the second leg inner surface at said inset portion is about 0.256 inch.

11. A circuit breaker comprising:

a circuit breaker housing;

at least one pair of separable contacts including a stationary contact and a movable contact disposed in said circuit breaker housing;

an operating mechanism disposed in said circuit breaker housing and coupled to said contacts and structured to move said contacts between a first, open position and a second, closed position;

a trip mechanism disposed in said circuit breaker housing and coupled to said operating mechanism and structured to actuate said operating mechanism to separate said contacts;

a slot motor assembly disposed about said contacts, said slot motor assembly having an upper slot motor assembly and a lower slot motor assembly, said lower slot motor assembly disposed below said stationary contact said upper slot motor assembly disposed above said movable contact;

said upper slot motor assembly including a housing assembly and a plurality of plates, said plates generally corresponding to the shape of said housing assembly;

said housing assembly having a U-shape with a bight, a first and second leg, and a gap between said legs;

said gap having a narrow portion and a wide portion;

wherein:

said gap wide portion is disposed adjacent to said bight; and said gap narrow portion is disposed adjacent to the distal ends of said first and second legs.

12. The circuit breaker of claim 11, wherein the width of the gap wide portion is between about 0.351 and 0.361 inch.

13. The circuit breaker of claim 12, wherein the width of the gap wide portion is about 0.356 inch.

14. The circuit breaker of claim 11, wherein the width of the gap narrow portion is between about 0.251 and 0.261 inch.

15. The circuit breaker of claim 14, wherein the width of the gap narrow portion is about 0.256 inch.

16. A circuit breaker comprising:

a circuit breaker housing;

at least one pair of separable contacts including a stationary contact and a movable contact disposed in said circuit breaker housing;

an operating mechanism disposed in said circuit breaker housing and coupled to said contacts and structured to move said contacts between a first, open position and a second, closed position;

a trip mechanism disposed in said circuit breaker housing and coupled to said operating mechanism and structured to actuate said operating mechanism to separate said contacts;

a slot motor assembly disposed about said contacts, said slot motor assembly having an upper slot motor assembly and a lower slot motor assembly;

said lower slot motor assembly disposed below said stationary contact;

said upper slot motor assembly disposed above said movable contact;

said upper slot motor assembly including a housing assembly and a plurality of plates, said plates generally corresponding to the shape of said housing assembly;

said housing assembly having a U-shape with a bight, a fiat and second leg, and a gap between said legs;

said gap having a narrow portion and a wide portion:

wherein:

said upper slot motor assembly housing includes a front plate, and an inner-support, each having a U shape;

said a front plate and said inner-support each having an inset portion and a stepped out portion, said inset portion corresponding to said gap narrow portion and said stepped out portion corresponding to said gap wide portion; and wherein each plates of said plurality of plates are shaped to correspond to the shape of said upper slot motor assembly housing front plate.

17. A circuit breaker comprising a circuit breaker housing;

at least one pair of separable contacts including a stationary contact and a movable contact disposed in said circuit breaker housing, an operating mechanism disposed in said circuit breaker housing and coupled to said contacts and structured to move said contacts between a first, open position and a second, closed position;

a trip mechanism disposed in said circuit breaker housing and coupled to said operating mechanism and structured to actuate said operating mechanism to separate said contacts;

a slot motor assembly disposed about said contacts, said slot motor assembly having an upper slot motor assembly and a lower slot motor assembly;

said lower slot motor assembly disposed below said stationary contact;

said upper slot motor assembly disposed above said movable contact;

said upper slot motor assembly including a housing assembly and a plurality of plate; said plates generally corresponding to the shape of said housing assembly:

said housing assembly having a U-shape with a bight, a first and second leg, and a gap between said legs;

said gap having a narrow portion and a wide portion;

wherein;

each said housing assembly includes a U shaped inner-support with a bight, a first and second leg;

said first and second leg each having an inner surface;

each said leg has a inner surface having a inset portion and a stepped out portion, wherein said first leg inset portion is closer to the second leg inset portion than the first leg stopped out portion is to the second leg stepped out portion; and wherein the distance between the first leg inner surface and the second leg inner surface at said stepped out portion is between about 0351 and 0.361 inch.

18. The circuit breaker of claim 17, wherein the distance between the first log inner surface and the second leg inner surface at said stepped out portion is about 0.356 inch.

19. A circuit breaker comprising:

a circuit breaker housing;

at least one pair of separable contacts including a stationary contact and a movable contact disposed in said circuit breaker housing;

an operating mechanism disposed in said circuit breaker housing and coupled to said contacts and structured to move said contacts between a first, open position and a second, closed position;

a trip mechanism disposed in said circuit breaker housing and coupled to said operating mechanism and structured to actuate said operating mechanism to separate said contacts;

a slot motor assembly disposed about said contacts, said slot motor assembly having an upper slot motor assembly and a lower slot motor assembly;

said lower slot motor assembly disposed below said stationary contact;

said upper slot motor assembly disposed above said movable contact;

said upper slot motor assembly including a housing assembly and a plurality of plates, said plates generally corresponding to the shape of said housing assembly;

said housing assembly having a U-shape with a bight, a first and second leg, and a gap between said legs;

said gap having a narrow portion and a wide portion;

wherein:

each said housing assembly includes a U shaped inner-support with a bight, a first and second leg;

said first and second leg each having an inner surface;

each said leg has a inner surface having a inset portion and a stepped out portion, wherein said first leg inset portion is closer to the second leg inset portion than the first leg stepped out portion is to the second leg stepped out portion; and wherein the distance between the first leg inner surface and the second leg inner surface at said inset portion is between about 0.251 and 0251 inch.

20. The circuit breaker of claim 19, wherein the distance between the first leg inner surface and the second leg inner surface at said inset portion is about 0.256 inch.

* * * * *